United States Patent [19]

Tokumoto et al.

[11] 4,016,052

[45] Apr. 5, 1977

[54] ELECTRODEPOSITION PROCESS

[75] Inventors: Shin-Ichi Tokumoto; Eiji Tanaka; Kenji Ogisu; Hiroji Kawai, all of Yokohama, Japan

[73] Assignee: Sony Corporation, Tokyo, Japan

[22] Filed: Nov. 17, 1975

[21] Appl. No.: 632,808

[52] U.S. Cl. ..... 204/64 T; 204/39

[51] Int. Cl.[2] ..... C25C 3/00

[58] Field of Search ..... 204/39, DIG. 10, 64 T

[56] References Cited

UNITED STATES PATENTS

| | | | |
|---|---|---|---|
| 2,935,454 | 5/1960 | Tokumoto | 204/39 |
| 3,699,014 | 10/1972 | Eisner | 204/DIG. 10 |
| 3,753,889 | 8/1973 | Eisner | 204/DIG. 10 |

*Primary Examiner*—John H. Mack
*Assistant Examiner*—H. A. Feeley
*Attorney, Agent, or Firm*—Lewis H. Eslinger; Alvin Sinderbrand

[57] ABSTRACT

In an electrodeposition process using a fused-salt electrolyte in which a desired metal or alloy deposited by electrolysis can be dissolved, and/or using a fused-salt electrolyte from which a highly viscous material is produced on the surface of an electrodeposited metal or alloy upon electrodeposition of the desired metal or alloy, solid particles are dispersed in the aforesaid electrolyte in order to obtain a flat surface of the desired electrodeposited metal or alloy, whereby continuous electrodeposition can be carried out.

10 Claims, No Drawings

ELECTRODEPOSITION PROCESS

BACKGROUND OF THE INVENTION

1. Field of the Invention

The present invention relates to a continuous electrodeposition process wherein solid particles are dispersed in a fused-salt electrolyte to obtain an electrodeposited metal or alloy which is extremely flat and free of flaws on the surface of cathode immersed in the electrolyte.

2. Description of the Prior Art

In the prior art, when a desired metal or alloy is to be electrodeposited as a solid by fused-salt electrolysis, the electrodeposited metal is often in the form of a powder, aggregate crystal, dendrite or sponge. When the desired metal or alloy electrodeposited in the above form is recovered, a great amount of electrolyte is inevitably lost during separating the metal or alloy from the electrolyte. Further, when the desired metal or alloy has high reactivity with oxygen, nitrogen and the like, the high surface area caused by the aforesaid form of the electrodeposited metal is subject to contamination by reaction with such different elements. Thus, after treatments of the deposited metal are usually accompanied by many difficulties.

Further, even when the metal or alloy can be electrodeposited as a relatively homogeneous film, conditions which permit such to be obtained are very narrow, e.g., a small allowable limit for the cathode current density and so on. Accordingly, undesirable restrictions have been imposed on processes for producing such film materials.

U.S. Pat. No. 3,662,047 issued May 9, 1972, in the name of Tokumoto et al discloses a method for the electrodeposition of titanium or a titanium alloy. A fused salt electrolytic bath containing a mixture of chloride salts of barium, magnesium, sodium and calcium having a freezing point of less than 600° C and titanium dichloride, and, if desired, a source of a suitable metal alloy, is electrolyzed. The electrolytic bath is maintained at a temperature of 400° to 580° C and under such conditions as will maintain the molar ratio of titanium trichloride to titanium dichloride at less than 0.5 in the vicinity of the electrode to be electrodeposited.

SUMMARY OF THE INVENTION

Accordingly, a main object of this invention is to provide an electrodeposition process which improves upon the above identified processes and/or is free from the above drawbacks.

Another object of this invention is to provide an electrodeposition process wherein a fused electrolyte is used, even with a metal whose electrodeposition as a relatively homogeneous, dense film is considered difficult, whereby a desired metal or alloy can be electrodeposited with its surface being kept flat on an electrode under operating conditions which are industrially useful, whereby a relatively homogeneous, dense film of electrodeposited metal or alloy having a predetermined thickness and high flatness can be obtained.

The above and other objects of the present invention are obtained by the presence of dispersed particles in the electrodeposition bath during the electrodeposition. While the particles may be added per se to the electrodeposition bath or formed in situ, in both instances the agitation effect of the dispersed particles permits one to obtain an electrodeposited metal or alloy layer which is extremely flat and free of flaws at the surface of the cathode in the electrodeposition bath.

The above and other objects and features of the invention will appear more fully hereinafter from a consideration of the following description accompanied with preferred embodiments.

DESCRIPTION OF THE PREFERRED EMBODIMENTS

Before the description of the present invention, a fused electrolyte as is normally used in a fused salt electrolysis will be described.

A fused electrolyte or electrolytic bath capable of dissolving a desired metal or alloy deposited by electrolysis comprises a higher valent compound of the desired metal in the fused electrolyte which reacts with electrodeposited metal to produce a lower valent compound of the desired metal, thus providing the deposited metal corroded and dissolved therein. One example thereof is a fused electrolyte where an electrodeposited metal is corroded and dissolved in the electrolyte by a disproportional reaction or disproportionation. A disproportionation of this kind will be described with reference to the electrodeposition of titanium, by way of example. As will be appreciated by one skilled in the art, in the electrodeposition of titanium from a fused-salt electrolyte, the starting material actually used in $Ticl_4$, which is reduced into $TiCl_3$ and $TiCl_2$ in a conventional manner. Since in the electrodeposition of titanium using a fused-salt delectrolyte this step inherently occurs, in the following examples the starting portions of $TiCl_2$ and $TiCl_3$ are given for purposes of convenience, as such terminology is more conventionally used in the art.

Between a higher valent compound of titanium such as $TiCl_3$, $K_2TiCl_6$, $BaTiCl_6$ or the like contained in a fused electrolyte and metallic titanium deposited by electrolysis, the following disproportionation exists at least in the temperature range of about 400° to 600° C.

$$Ti + 2TiCl_3 \rightarrow 3TiCl_2 \quad (1)$$

$$Ti + K_2TiCl_6 \rightarrow 2KCl + 2TiCl_2 \quad (2)$$

$$Ti + BaTiCl_6 \rightarrow BaCl_2 + 2TiCl_2 \quad (3)$$

When a trivalent complex of titanium such as $Cs_2TiCl_5$ is present in the electrolyte, a similar disproportionation is also seen. In either case, however, the metallic titanium deposited by the electrolysis reacts with a higher valent titanium compound, such as a trivalent or tetravalent compound, in the electrolyte to produce a lower valent titanium compound, such as a divalent compound, which is dissolved in the electrolyte.

Another example of a fused electrolyte capable of dissolving a desired metal or alloy deposited by electrolysis is one where the metal or alloy can be subjected to anodic dissolution in the fused electrolyte.

A further example of a fused electrolyte capable of dissolving a desired metal or alloy deposited by electrolysis is one where the desired metal is locally dissolved in the electrolyte by the electromotive force of a concentration cell based upon the concentration difference of desired metal ions locally produced on the surface of the electrodeposit (hereinafter referred to as a deposit surface).

A description will now be given of a fused electrolyte used in the electrodeposition process of this invention in which a highly viscous material is produced on the deposit surface of a metal or alloy during electrodeposition of the desired metal or alloy as described above.

It will be apparent that in the case where, for example, an intermittent DC current (cut on and off at predetermined periods and at predetermined rates) is used as an electrolytic current during electrodeposition of a desired metal, if the electrolytic current is cut off the afore-mentioned disproportionation will occur on the deposit surface without interference.

Referring to the above described reaction formulas (1), (2) and (3) relating to titanium, by way of example, as is obvious from these reaction formulas, the amount of $TiCl_2$, KCl, $BaCl_2$ or the like increases to more than the starting composition ratio of the electrolyte itself at the reacting areas on the deposit surface of the metal. Accordingly, when the composition of the fused electrolyte is selected to be substantially at or near the liquidus line or face of the fused-salt phase diagram (but in the liquid region) at the electrolyte temperature with respect to the components whose concentration is increased at the metal deposit surface by the reaction, it will be seen that at least a portion of the by-products produced by the electrodeposition will be in the form of a highly viscous material which will cover the reacting area of the deposit surface.

Further, another example of a fused electrolyte used in this invention will be described with reference to the electrodeposition of titanium. In the case that a fused electrolyte composed of alkali and/or alkaline earth chloride and titanium chloride has magnesium chloride added thereto to deposit magnesium metal preferentially next to the titanium in accordance with their decomposition voltages, the thus deposited metallic magnesium is substituted for by titanium which is present in the fused electrolyte to form magnesium chloride ($Mg + TiCl_2 \rightarrow MgCl_2 + Ti$) which returns to the fused electrolyte by a rehalogenization reaction. If the composition of the fused electrolyte is selected to be substantially at or near the liquidus line or face of the electrolyte phase diagram at the electrolyte temperature with respect to magnesium chloride, at least a part of the magnesium chloride will form a highly viscous material. Of course, in this case, the electrolyte must flow and move relative to the deposit surface.

The above described electrolytes are only examples of fused electrolytes which can be used in this invention, and it is needless to say that the present invention is not limited to the above illustrative materials.

As will be obvious from the above description, in a fused electrolyte for use in the electrodeposition process of this invention, an electrolyte having a different composition from that of the original fused electrolyte is produced at areas adjacent to the deposit surface of metal or alloy. The electrolyte at this portion will hereinafter be referred to as "a deviated electrolyte portion" meaning a portion of the electrolyte having a compositional deviation from the original fused electrolyte. As will be appreciated by one skilled in the art, the "deviated electrolyte" differs from the main portion or balance of the fused electrolyte primarily in having a higher viscosity than the main portion or balance of the fused electrolyte and in having a higher percentage of electrolytic by-products, mostly anions released from the metal electrodeposited and, for example, $MgCl_2$ due to rehalogenation when an electrolytic system comprising $MgCl_2$ as described, for example, in U.S. Pat. No. 3,662,047 Tokumoto et al, is utilized. The "deviated electrolyte" can be considered equivalent to the highly viscous material produced during the electrodeposition.

Furthermore, in the following description, so far as it is not necessary to distinguish an alloy from a single metal for purposes of understanding the disclosure, the term "alloy" will be omitted from the explanation.

While the process of the present invention finds wide application, it finds particular use as an improvement of the method described in U.S. Pat. No. 3,662,047 Tokumoto et al, which patent is here by incorporated by reference, where solid particles are added per se to the electrodeposition bath of the Tokumoto et al patent or formed in situ therein, thereafter the particles being agitated in the electrodeposition bath to provide the effects now to be described and to permit one to obtain an electrodeposited metal or alloy layer which is extremely flat and free of flaws at the surface of the cathode upon which electrodeposition is proceeding.

As indicated, the primary feature of the present invention involves dispersing solid particles in a fused-salt electrolyte electrodeposition bath so as to utilize the agitation effect of the dispersed solid particles to obtain a metal or alloy layer which is extremely flat and free of flaws. The following discussion deals with such particles in detail.

The solid particles of the present invention may be added per se to the electrodeposition bath or may be formed therein by an in situ crystallization procedure as will later described. Of these two embodiments, the in situ crystallization of solid particles is preferred.

There is no particular limitation on the identity of the solid particles, but, as will be apparent, when the solid particles are formed of components which are different from the components of the reaction system and are undesired in the reaction system, the solid particles should not melt, degrade or be abraded at the electrodeposition conditions. Particularly preferred crystallized salt particles are the particles of components used as the raw material of the desired metal, though as will be apparent to one skilled in the art from the later offered examples, the crystallized salt particles need not necessarily comprise the raw material of the desired metal, and can comprise other components of the fused electrolyte, either alone or as various admixtures thereof. However, most preferred solid particles which are in situ crystallized are $TiCl_2$ solid particles. As other solid particles which can be dispersed, there can be employed compound particles such as oxide particles, nitride particles, boride particles, carbide particles, sulfide particles, bromoide particles, chloride particles, fluoride particles or the like, and/or carbon articles or metallic particles.

It is generally preferred that the solid particles dispersed in the fused electrolyte during the electrodeposition of the present invention have a size less than about 1 mm. At the same time, it is preferred that the solid particles dispersed in the fused electrolyte have a size greater than about 1 micron. Most preferably, the solid particles dispersed in the fused electrolyte have a size greater than about 20 microns but less than about 200 microns. If the solid particles dispersed in the fused electrolyte are too fine, the effect of the present invention is not achieved. On the other hand, if the solid particles dispersed in the fused electrolyte are too large, uneconomical amounts of power are required to maintain the solid particles dispersed in the fused electrolyte.

It should be understood by one skilled in the art, of course, that all solid particles need not be exactly the same size, and particles of a varying size distribution can be dispersed in the fused electrolyte to achieve the unique effect of the present invention.

Further, it should be apparent to one skilled in the art that not all of the solid particles dispersed in the fused electrolyte need have a size in the above range. However, practically speaking, particles much finer than the above range do not lend any substantial beneficial effect to the electrodeposition, nor do solid particles substantially outside the above range, and hence it is preferred that such not be present at all.

It should further be apparent to one skilled in the art that, if desired, solid particles can be added to the system in combination with the formation of solid particles formed by in situ crystallization. Generally speaking, however, no substantial benefits are obtained by utilizing such a more complicated system, and on an industraial scale the general rule will be that particles will be exteriorly added to the fused-salt electrolyte or the solid particles will be formed therein by an in situ crystallization, with the latter procedure being preferred. In this regard, it should be noted that while nothing would prevent solid particles which are identical to those formed by an in situ crystallization from being added exteriorly from the fused electrolyte, little is to be gained by such a procedure.

The shape of the particles in the present application is not overly important, and the particles can be circular, irregular, accicular, etc., and mixtures thereof can be used, if desired. Generally speaking, however, it is preferred to utilize particles of approximately the same shape since this makes process reproducibility easier.

For an easy understanding of the fact that the electrodeposition process according to this invention is superior to the prior art, a description will now be given on the operation and effect of crystallized-salt particles produced from the aforesaid electrolyte and of other solid particles added exteriorly of the fused electrolyte.

In the electrodeposition process of this invention, the deviated electrolyte portion is produced adjacent the deposit surface as described above.

When the fused electrolyte is flowed and moved relative to the deposit surface, an electrolyte portion showing a particular fluid condition called a boundary layer in the fluid dynamics art is produced along the deposit surface. Within this boundary layer, the further away from the deposit surface a portion of the boundary layer is, the greater the relative velocity of the electrolyte to the deposit surface in that portion. Accordingly, the portion within this boundary layer immediately adjacent the deposit surface can be substantially considered a diffusion-dominated area with respect to mass transfer. The thickness of this boundary layer is determined with regard to the relative velocity of electrolyte to the deposit surface, the viscosity of electrolyte and the like, but it becomes thin as the viscosity of the electrolyte becomes small and as the relative speed to the deposit surface becomes high. In a turbulent flow area of the elecrolyte produced by a further increase of this relative velocity, there remains only a very thin layer which is a laminar sublayer. Accordingly, in the case of turbulent flow, when the electrolyte flows and moves relative to the deposit surface, the projections on the deposit surface are in greater contact with the original electrolyte than the recessions therein. In such a case, if solid particles exist in the electrolyte, and their sizes are the same as or greater than the thickness of the boundary layer and are large enough for them to be affected by the relative velocity distribution in the boundary layer, the solid particles are swept along the deposit surface or rotated, depending on their relative velocity distribution, so that the solid particles are moved relative to the deposit surface with the effect of agitating the electrolyte near the deposit surface. Consequently, as will be obvious from fluidized bed engineering, there will be achieved a reduction in the thickness of the portion considered a substantially diffusion-dominant area. Accordingly, it will be apparent that when solid particles of a size large enough to achieve the effect of reducing the thickness of the portion considered substantially diffusion-dominant as mentioned above is dispersed in the electrolyte for the electrodeposition and the electrolyte flows and moves relative to the deposit surface, the result is to increase its limit density with respect to the cathode current density. While U.S. Pat. No. 3,662,047 Tokumoto et al generally discloses the formation of a highly viscous layer at projections and depressions during electrodeposition, there is no disclosure whatsoever therein of the utilization of dispersed solid particles as in the present invention to achieve the unique effect of the present invention.

Therefore, the electrodeposition process of this invention is designed to achieve a novel effect due to the above mentioned dispersed solid particles utilizing the special conditions of fused salt electrolysis in which operation is carried out at a relatively higher temperature than is normally used in a fused salt electrolysis, wherein a fused salt consisting of a pluralit of component salts is used as the electrolyte. Electrodeposition is carried out at a temperature above the melting point of the fused-salt electrolyte and at a temperature below the temperature at which substantial volitilization of the fused-salt electrolyte occurs. Electrodeposition is most preferably carried out at a temperature of from about 400° to about 550° C, most preferably, at a temperature from 400° to 500° C, though with certain fused-salt electrolytes it is possible to perform electrodeposition at somewhat lower and somewhat higher temperatures.

Generally, in such an electrodeposition, the raw material of the desired metal is reduced into its metal from the electrolyte adjacent the deposit surface due to electrolytic current and successively extracted therefrom. When a comparison is made between the concentrations of the raw materials of the reducible desired metals contained in the portions of electrolyte adjacent to the projections and recessions of the deposit surface, the concentration of the raw material in the electrolyte adjacent to the recessions is apt to be smaller than that adjacent the projections and this tendency becomes notable as the cathode current density becomes higher. In order to avoid the above defect, violent agitation of electrolyte is normally carried out during the electrodeposition.

In an electrodeposition process carried out at a fused electrolyte temperature near the liquidus line or face, the fluidity of the electrolyte is relatively small, so that even with violent agitation it is difficult to supply a sufficient amount of raw material to the electrolyte portion adjacent the deposit surface from which the raw material of desired metal can be gradually extracted due to the reduction to the desired metal by the electrolytic current.

In one embodiment of the electrodeposition process of this invention, the original or starting electrolyte contains the raw material (which provides the desired metal) in an amount greater than its solubility at the electrolysis temperature, so that the amount of the component exceeding the solubility thereof at the electrolysis temperature is dispersed in the electrolyte as solid particles. When such an electrolyte flows and moves relative to the deposit surface, as previously described above, the following effects are achieved: the thickness of the portion adjacent the deposit surface considered substantially a diffusion-dominant area can be made very thin. However, when the solution concentration of the raw material of the desired metal becomes low in this area as a result of deposition of the desired metal according to electrolytic current, the solid particles of the raw material present by dispersion in this portion dissolve to compensate for the shortage of the solution concentration. Therefore, the shortage of the raw material of the desired metal in the recessions of the deposit surface, that is, concentration polarization of the component, can be remarkably prevented, though it is normally apt to occur. This is the reason why in the electrodeposition process of this invention solid particles particularly suitable as particles dispersed in the fused electrolyte are the compound particles of the raw material of desired electrodeposition metal among the crystallized salt particles.

As previously mentioned, in the fused electrolyte the thickness of the portion adjacent the deposit surface which can be considered a substantially diffusion-dominant area becomes very thick when the solid particles are not present. However, when the difference between contact rate of the original electrolyte at the projections and recessions of the deposit surface is utilized to increase the dissolution of the metal at the projections much more than at the recessions to flatten the deposit surface according to the disproportionation previously described in detail with reference to the electrolyte used in the electrodeposition process of this invention, the small height difference between the recessions and the projections of the deposit surface provides a remarkable difference in the amount of disproportionation as the boundary layer produced on the deposit surface is thinned due to the existence of the solid particle, so that the effect of flattening the deposit surface is achieved.

Even when a continuous electrodeposition is carried out with the deposit surface rendered flat by using both the electrolytic current with a periodic reversal of the electrolytic current as disclosed in U.S. Pat. No. 3,662,047 Tokumoto et al. to dissolve the deposit surface for a predetermined period during electrolysis, continuous electrodeposition is performed with the deposit surface being flattened utilizing the concentration difference between the raw materials of the desired metal contained in the electrolytes adjacent the recessions and projections of the deposit surface, if the boundary layer produced on the deposit surface is made thin by the solid particles. The flattening effect will be remarkably achieved due to a slight difference between recessions and projections of the deposit surface in a manner similar to that described in the case of the flattening effect utilizing disproportionation.

Further, in the case of electrodeposition of a metal as previously described, when the electrodeposition is carried out using a fused electrolyte which produces a highly viscous material on the surface of electrodeposited metal, the highly viscous material produced on the deposit surface may not be sufficiently removed even though the relative velocity of the electrolyte consisting only of solution is greatly increased with respect to the deposit surface unless the solid particles are dispersed in the electrolyte. In a practical case, if such an electrode position operation is carried out, a nonmetallic coloring called "burnt marks" is apt to appear on the deposit surface, or crater-shaped dents or pits are apt to appear accidentally. If solid particles are dispersed in the electrolyte when the above mentioned problems are noticed, the aforesaid dents or pits disappear or their rate of appearance is decreased. It is believed that the agitating effect of the dispersed solid particles moving along the flow of electrolyte and their mechanical polishing operation serves to remove the abovementioned highly viscous material.

In the case when the above-mentioned highly viscous material is produced due to the increase of raw material of the desired metal on the deposit surface as in the case of, for example, titanium dichloride in the electrodeposition of titanium, the balance between the amount of the above increased raw material and the amount of electrodeposited metal is kept in the proper range by properly controlling, for example, the disproportionation speed and electrolytic current density and, further, the dispersed solid particles are present in the electrolyte, whereby good electrodeposition is achieved. However, when an electrolytic component such as KCl, $BaCl_2$, $MgCl_2$, or the like, other than the raw material of the desired metal is involved in the production of the highly viscous material of the electrolyte produced on the deposit surface as described above, it is difficult to completely and positively remove the solid or highly viscous material of the electrolyte relying only on physical operations such as agitating and mechanical polishing of the solid particles. In such a case, if the compsotion of a fused-salt electrolyte is selected so that the solubility of KCl at the electrolyte temperature is increased by increasing the amount of $MgCl_2$ as, for example, in the electrolyte shown in Example 5 to be described later, and a fusion having a low melting point is produced, the above mentioned drawbacks can be completely and reliably prevented in cooperation with the afore-mentioned effective agitation effect by the solid particles, though the amount of each salt which has been increased over it solubility level may produce a highly viscous material on the deposit surface, unless a plurality of salts intermingle with each other.

For reliable formation and fusion of the above mentioned highly viscous material, it is advisable that electrolytic conditions having different rates of increasing the amount of the two or more components be alternately combined to continue the electrodeposition as shown in Example 5. Similarly, solid particles such as those of a barium salt, a sodium salt or the like must also be taken into consideration with reference to the electrolysis operating conditions, such as the electrolyte temperature and the like, upon determining the composition of the original fused-salt electrolyte so that the viscosity of the deviated electrolyte portion at the electrolytic temperature and the solubility of the raw material of the desired metal at the aforesaid deviated electrolyte portion, e.g., the titanium salt in Example 5, may be maintained in the desirable condition.

In order to disperse solid particles in a fused electrolyte, the velocity of the electrolyte must be more than the minimum fluidization velocity of the solid particles, which is determined upon considering the size, shape and specific gravity of the particles. In order to provide the velocity necessary to achieve the above object to the fused electrolyte, a mechanical agitating means is used such as a bubble type agitator, a propeller type agitator, a fan turbine type agitator, a slanting-blade fan turbine type agitator, an arrow fan turbine type agitator, a helical shaft or helical ribbon agitator, or fluid transport means such as one or more pumps. It is needless to say that the aforesaid object can be sufficiently attained using such and other means and the exact agitation method selected is not particularly limited. It is often preferred, however, to rotate or vibrate the cathode, either at a constant rate or by periodically varying the rate of rotation or vibration of the cathode. For the case of rotation, a rotation rate in the range of about 70 to about 2500 rpm is often conveniently used.

Further, particularly in order to disperse crystallized-salt particles into a fused electrolyte, the following method is preferred.

With respect to a component salt of the desired crystallized salt particles to be dispersed into a fused electrolyte, the temperature of the fused electrolyte is decreased so as to obtain the desired amount of crystallized-salt particles at the electrolytic temperature with reference to the liquidus line or face of the phase diagram of the electrolyte and the solubility. Generally, the desired amount of crystallized-salt particles at the electrolytic temperature is decided, the electrolytic temperature is selected, and thereafter a batch of materials which will provide the desired fused-salt electrolyte and the desired amount of crystallized-salt particles blended, whereafter the temperature of the electrolyte is raised to a temperature sufficient to substantially completely melt, most preferably completely melt, the composition whereafter the composition is cooled to the electrolytic temperature to thereby form the crystallized-salt particles, the component salt in an amount corresponding to the difference between the solution concentration of the component salt at the original high temperature and that of the component salt at the electrolysis temperature is precipitated into the electrolyte as solid particles The shape and size of the precipitated solid particles can be controlled by the time required to lower the electrolyte temperature from the original high temperature to the electrolysis temperature, the agitating condition of the electrolyte, and the type of precipitated component salt using conventional techniques as are common in the crystallization art. When the electrolysis apparatus is provided with exterior cooling means, for example, at least a portion of the walls of the electrolysis apparatus is provided with a cooling jacket to perform the above described cooling of fused electrolyte, the amount of crystallized component depositied on its surface is affected by the type of precipitated component salt, the agitating condition of the electrolyte and the like, in a manner similar to the foregoing.

Further, it is most preferred that at least a portion of the walls of the electrolysis apparatus be provided with heating means so that the amount of electrolyte deposited on the wall surface, which has no relation to the electrolysis, can be reduced. However, when the electrolyte is kept at the electrolysis temperature for a long time, the solid particles gradually precipitate and accumulate at the bottom of the electrolyzer. These accumulated solid particles may be sometimes used again merely by a simple mechanical agitation even after the passage of one day and night. A fused electrolyte shown in Example 6 is an electrolyte of this kind. However, when the crystallized particles accumulated at the bottom of the electrolysis apparatus are gradually welded and one night passes at the same temperature, they frequently aggregate into the shape of a solid sheet. In such a case, it is necessary that the aggregate be fused by increasing its temperature and the above described operation for forming solid particles be repeated. In order to overcome this problem, it is necessary to keep the conditions of the crystallized particles near the electrodeposition electrode at the desired constant conditions in such a manner that, as shown in Example 5, the temperature of the portion within the electrolysis apparatus where crystallized particles are liable to be precipitated (mainly, the bottom of the electrolysis apparatus) is kept high, whereby the crystallized particles precipitated onto the aforesaid portion are fused, and the resulting solution is shifted to a low temperature portion of the electrolyte, thereby continuously producing crystallized particles. Further, if a separate high temperature bath compartment is provided, electrolyte and crystallized particles can be removed from the lower part of the low temperature portion of electrolyte to the aforesaid high temperature bath compartment through a passageway which is slightly slanted so tha a large amount of crystallized particles cannot accumulate thereon, and the electrolyte again circulated to the low temperature portion after fusion.

In the embodiment of the present wherein solid particles are formed by in situ crystallization, it will be apparent to one skilled in the art, that if desired, three separate vessels can be utilized, i.e., a high temperature vessel wherein substantially all of the components of the fused-salt electrolyte are melted into the liquid state, a cooling vessel wherein in situ crystallization is conducted and an electrodeposition cell. However, as earlier indicated it is preferred to utilize a single vessel divided into three regions, i.e., a bottom high-temperature region wherein substantially all of the components of the fused-salt electrolyte are melted, an upper region which receives the product of the high-temperature bottom region wherein cooling is effected to perform in situ crystallization, and a middle region wherein electrodeposition is conducted. In the above embodiment, of course, coagulated large particles of crystallites which cannot be maintained in the flow of the electrodeposition zone fall down into the bottom high-temperature region and are remelted.

On a commercial scale, when solid particles are formed by in situ crystallization, typically the high temperature region wherein substantially all of the components of the fused salt electrolyte are melted into the liquid form is in the area of about 500° to about 560° C and the in situ crystallization region and the electrodeposition region are maintained at a temperature of about 400° to about 490° C, cooling tubes being provided in the crystallization region. The temperature differential between the electrodeposition temperature and the temperature wherein substantially all of the components of the fused-salt electrolyte are melted is not overly critical so long as the desired amount of the component or components to be crystallized can be placed into solution and then crystallized therefrom by cooling. Usually, a temperature differential of from about 30° to about 150° is used, and on an industrial scale a temperature difference on the order of 100° C is often used.

Next, in order to attain the afore-mentioned effect, particularly by dispersing solid particles in the fused electrolyte, the electrolyte must have a sufficient relative velocity at the deposit surface. It will be apparent that a sufficient relative velocity can be produced near the deposit surface by the above described mechanical fluid transport means with the cathode electrode being motionless or slowly revolving or shifting, and/or the aforesaid sufficient relative velocity can be produced by violently vibrating or rortating the cathode electrode as shown in the Examples.

As earlier indicated, the process of the present invention is of broad application, i.e., it finds general utility in electrodeposition systems wherein a desired metal or alloy electrodeposited by electrolysis can be dissolved in a fused-salt electrolyte and/or wherein a fused-salt electrolyte forms a highly viscous material on the surface of the electrodeposited metal or alloy.

The present invention does, however, find particular application in the electrodeposition of titanium or a titanium alloy from a fused salt electrolyte comprising $BaCl_2$, KCl, $MgCl_2$, $NaCl_2$, $CaCl_2$ and $TiCl_2$ and $TiCl_3$, most especially where the molar ratio of $TiCl_3$ to $TiCl_2$ is less than 0.5 in the vicinity of the cathode upon which electrodeposition is occurring.

If desired, the bromide form of the above materials may be utilized in accordance with the present invention (bromide-based system), but such is generally non-preferred.

It will be appreciated by one skilled in the art, of course, that the present invention is not limited to the electrodeposition of titanium or titanium alloys, but that other metals can be electrodeposited in accordance with the process of the present invention, for example, by utilizing the corresponding chloride(s) of metals other than titanium in a system as described above.

The average current density utilized during the electrodeposition of the present invention can be substantially varied, and to a large extent, is influenced by the size of the cathode selected. While definitive values cannot be set due to the wide variation in cathode size which can be utilized in the present invention, the general rule to be followed is that larger the cathode the higher the current density used, and the smaller the cathode the lower the current density used. Optimum current density is generally determined in an empirical fashion, i.e., as is conventional in the art a few process runs are conducted at varying average current densities until the current density which provides the best product is determined. For example, using a cathode with a diameter of 32 mm the maximum average current density may be bout 30 A/dm$^2$, whereas using a vibrating cathode of a larger size as would commonly be used on an industrial scale an average current density of 80 A/dm$^2$ or higher is realistic for the electrodeposition of titanium metal by the process of the present invention is an agitated bath, for example.

One particularly advantageous effect of the process of the present invention is that the present invention can be practiced at an extremely high current efficiency, for example, 70 to 80 % on a reproducible basis. This is a great improvement over conventional prior art fused-salt electrodeposition processes wherein substantially lower current efficiencies are obtained.

The electrodeposition process of this invention will now be described with reference to several Reference Examples and Examples.

As will be obvious from the following, the present invention comprises not only the above characteristics but also other characteristics which are preferably simultaneously utilized therewith.

Principle matters common in the Reference Examples and Examples were as follows:

The analysis of the component salts of the electrolyte composition was performed when the electrolyte was produced.

The illustrated titanium salt was quantitatively analyzed as $TiCl_2$ and $TiCl_3$ after metallic titanium and $TiCl_3$ were supplied to the electrolyte and caused to react with each other at a bath temperature of 560° C. The method of S. Mellgrem and W. Opie (refer to *Journal of Metals*, 266, 1957) was used as the above analysis method. This analysis method is based on the fact that $TiCl_2$ discharges hydrogen gas quantitatively upon reaction with a dilute acid solution as follows:

$$Ti^{+2} + H^+ \rightarrow Ti^{+3} + \tfrac{1}{2} H_2 \uparrow$$

That is, a sampled electrolyte at the operating temperature was suddenly cooled to produce a specimen which was placed in aqueous hydrochloric acid (0.7 % HCl) to generate hydrogen gas and the amount of the hydrogen gas measured to thereby determine $TiCl_2$ in the electrolyte, considering the hydrogen gas was generated from $TiCl_2$. $TiCl_3$ analysis was carried out in such a manner that the specimen was dissolved in aqueous hydrochloric acid (5% HCl), barium salt removed by adding awueous sulfuric acid (10%), whereafter titanium ions reducible by zinc amalgam were all reduced to $Ti^{+3}$ which was titrated with a standard $Fe^{+3}$ solution. The amount of the titanium salt produced by the above titration as $TiCl_3$ was subtracted from the amount of $TiCl_2$ to thereby determine the amount of $TiCl_3$.

With the above described titanium salt, a complex salt may be at least partially formed at the high temperature of the electrolyte in its fused condition. Except for the case where the electrolyte is added with solid particles which are independent of the original electrolyte component, the existence or absence of crystallized-salt particles in the electrolyte at the electrolysis temperature in an amount sufficient to have a substantial effect on the electrodeposition process of this invention was judged in the following manner.

The electrolyte was agitated at a temperature higher than the electrolysis, i.e., at a temperature high enough to melt all components of the fused electrolyte, and electrolyte immediately adjacent to the cathode position, which is 3 to 5 cm under the surface of the electrolyte was sampled for analysis. Next, with the temperature of the electrolyte lowered to electrolysis temperature and kept there without agitation for at least 10 hours, the electrolyte near the cathode position was sampled for analysis. Then, both of the above analyzed values were compared to each other; if a significant difference could be detected therebetween in view of the mechanism of the electrodeposition process of this invention, it was judged that the crystallized-salt particles were present in the electrolyte in an amount sufficient to have a substantial effect on the electrodeposition process of this invention.

As will be appreciated by one skilled in the fused-salt electrodeposition art, it is difficult to sample a fused-salt electrolyte at the elevated temperature or electrodeposition with complete accuracy, and, as will be apparent, such sampling is also difficult at the higher temperatures required for bringing the excess component or components which is/are later to be crystallized into solution. Considering the possibility of analytical error, the general rule used on an industrial scale is that if there is a difference of greater than 5 molar % in the amount of any one component to be crystallized at the elevated "solubilizing" temperature and at the crystallization temperature (the temperature of the electrodeposition), this is considered a "significant difference".

It is most preferred in accordance with the present invention that more than about 10 molar % but less than about 30 molar %, of at least one component in the fused electrolyte be crystallized as solid particles, i.e., based upon the amount of the component in the fused-salt electrolyte at the electrodeposition conditions a 10 to 30 molar % excess of that component is melted at the "solubilizing" temperature and then crystallized. As reference to the later given Examples will make clear, however, this range is not mandatory, merely preferred. Further, in all electrolytes except an electrolyte which had added thereto solid particles independent of the original electrolyte component, when an electrolyte sampled therefrom by the aforementioned method was dissolved in aqueous hydrochloric acid (5%) and filtered on a filter paper to collect insoluble component(s), the dissolved residue obtained by roasting the above insoluble component was less than 2 weight %, i.e, the in situ formed particles were substantially contaminant free.

Each electrolysis apparatus used except for that used in Example 5 was a test tube type container made of glass with an inner diameter of 75 mm and a depth of 500 mm provided with external heating means (using an electric heating furnace).

The depth of the electrolyte in each tube was about 20 cm.

In addition, the surface of electrolyte within the electrolysis apparatus was kept under an argon atmosphere at atmospheric pressure.

REFERENCE EXAMPLE 1

Electrodeposition in an electrolyte with no solid particles dispersed therein at the electrolysis temperature.

1. Composition of Electrolyte (In molar ratio):
$BaCl_2$ 12.70, $MgCl_2$ 23.80, $CaCl_2$ 10.52 NaCl 33.77, KCl 10.65, $TiCl_2$ 7.84 $TiCl_3$ 0.71
2. Temperature of Electrolyte: 460° C
3. Electrodes:
Cathode . . . Stainless steel cylinder 15 mm in diameter and 25 mm in length
Anode . . . Round carbon bar 8 mm in diameter, submerged portion 150 mm in length.
Distance between electrodes . . . about 30 mm
4. Electrolytic Current:
Intermittent DC with cathode current density of 35 A/dm$^2$
Intermitting period 0.6 sec
Current-On time 0.3 sec
Current-Off time 0.3 sec
5. Agitation: Rotation of cathode electrode at 2000 revolutions per minute (rpm)
6. Electrolysis Time: 30 min
7. Results (Appearance of Electrodeposit):
Black fine dendrites were grown in a shaggy state on the surface of a silver gray thin foil.

EXAMPLE 1

Electrodeposition with $SiO_2$ particles dispersed in the electrolyte of Reference Example 1.

1. Composition of Electrolyte:
An electrolyte composed of 2 kg of the electrolyte of Reference Example 1 having added thereto 500g of $SiO_2$ patticles having an average diameter of 200 $\mu$ (added exterior of the system).
2. Temperature of Electrolyte, (3) Electrodes, (4) Electrolytic Current and (5) Agitation were all in Reference Example 1. However, referring to the agitation, when the cathode electrode was rotated at 2000 rpm, it was noticed that an electrolyte vortex occurred under the cylindrical cathode electrode and a violent circulating flow of the electrolyte was generated to pull up $SiO_2$ particles dispersed thereinto.
6. Electrolysis Time: 1 hour
7. Results (Appearance of Electrodeposit):
Compact, thick plate having a glossy, smooth surface of fine crystals.

EXAMPLE 2

Even when an electrolyte having dispersed therein ground particles of sintered boron nitride having an average particle diameter of 150 $\mu$ (Tradename: DENKA BORONITRIDE HC-TYPE) was used in place of the $SiO_2$ particles contained in the electrolyte of Example 1, there was obtained an electrodeposit showing substantially the same appearance as in Example 1 above.

REFERENCE EXAMPLE 2

Electrodeposition using an electrolyte with no solid particles dispersed therein at the electrolysis temperature.

1. Composition of Electrolyte (In molar ratio)
$BaCl_2$ 9.09, $MgCl_2$ 28.85, $CaCl_2$ 12.18 NaCl 27.00, KCl 14.63, $TiCl_2$ 7.47 $TiCl_3$ 0.77
2. Temperature of Electrolyte: 460° C
3. Electrodes: Same as those of Reference 1.
4. Electrolytic Current:
Intermittent half-wave rectified current of single-phase AC of 50 c/s having a cathode current density of 50 A/dm$^2$ (peak value).
Intermitting period 0.6 sec
Current-On time 0.15 sec
Current-Off time 0.45 sec.
5. Agitation: Rotation of cathode electrode at 2000 rpm.
6. Electrolytic Time: 30 min
7. Results (Appearance of Electrodeposit):
Black fine dendrites were grown in a shaggy state on the surface of a silver-gray thin foil. The amount of dendrites was much more than that of the electrodeposit of Reference 1.

EXAMPLE 3

Electrodeposition using an electrolyte in which crystallization and dispersion of a $TiCl_2$ component was observed at the electrolysis temperature.

1. Composition of Electrolyte (In molar ratio)

$BaCl_2$ 8.77, $MgCl_2$ 26.06, $CaCl_2$ 11.50 NaCl 25.96, KCl 12.61, $TiCl_2$ 14.61 $TiCl_3$ 0.60

2. Temperature of Electrolyte, (3) Electrodes (4) Electrolytic Agitation and (6) Electrolytic Time were all the same as those of Reference Example 2. Prior to the electrodeposition, the above fused electrolyte was raised to a temperature sufficient to melt the same and then cooled to the electrodeposition temperature, whereafter electrodeposition was conducted. The solid particles of $TiCl_2$ were estimated to have a size on the order of the solid particles as were added exterior of the system in Example 1 and Example 2.

7 Results (Appearance of Electrodeposit):

Compact plate having a semi-glossy flat surface made of fine crystals.

EXAMPLE 4

Electrodeposition in an electrolyte wherein crystallization and dispersion of a $BaCl_2$ component was observed at the electrolysis temperature.

1. Composition of Electrolyte (In molar ratio)

$BaCl_2$ 15.12, $MgCl_2$ 28.44, $CaCl_2$ 11.35 NaCl 25.42, KCl 11.28, $TiCl_2$ 8.05 $TiCl_3$ 0.34

2. Temperature and Electrolyte and (3) Electrodes were the same as those of Reference Example 2.

The above fused electrolyte was raised to a temperature sufficient to melt the same, and thereafter cooled to the electrodeposition temperature to crystallize solid particles of $BaCl_2$. The solid particles were estimated to have a size on the order of the solid particles added exterior of the system in Examples 1 and 2.

4. Electrolytic Current:

Intermittent half-wave rectified current of single-phase AC of 50 c/s having a cathode current density of 50 A/dm$^2$ (peak value).

Intermitting period — 0.15 sec

Current-On time — 0.11 sec

Current-Off time — 0.04 sec

5. Agitation and (6) Electrolytic Time were the same as those of Reference 2.

7. Results (Appearance of Electrodeposit):

Compact plate having a semi-glossy flat surface made of very fine crystals.

EXAMPLE 5

Electrodeposition in an electrolyte wherein crystallization and dispersion of $BaCl_2$, KCl, $MgCl_2$, NaCl and $TiCl_2$ components was observed at the electrolytic temperature.

The electrolysis apparatus used in this example was as follows:

A square electrolyzer of the internal heating type was used and 180 liters of electrolyte filled therein so to provide an electrolyte 135 cm in depth. The electrolyte surface within the electrolyzer was kept under an argon atmosphere. With the temperature of the electrolyte being kept at more than 520° C to melt the components at the bottom of the electrolyzer, the electrolyte was agitated by a stainless-steel propeller type agitator, where the speed of the propeller type agitator was controlled so that the electrolyte composition near the cathode electrode was kept substantially constant.

A stainless steel pipe 100 mm in length, 32 mm in outer diameter and 1.5 mm thick was employed as a rotating cathode electrode. For this purpose, the pipe was attached to the top end of a stainless steel rotary shaft 25 mm in outer diameter via a copper conductive ring. The opening at the tip of the cathode pipe was covered with a procelain nut, and the cathode electrode inserted into the electrolyte for rotation so that the cathode electrode was positioned between 5 cm and 15 cm under the electrolyte surface with the porcelain nut facing downward and the rotary shaft substantially vertical. The portion of the rotary shaft located above the cathode electrode and submerged in the electrolyte was covered with a porcelain cylinder whose outer diameter was substantially the same as that of the cathode pipe.

As the anode electrode there were used two 1.5 cm thick sheets of square carbon plate with each side 20 cm long. These two carbon sheets were immersed in the fused electrolyte symmetrically disposed opposite to each other with the cathode electrode being interposed therebetween, keeping each carbon plate from the cathode a distance of 15 cm.

Further, a pouch-like partition membrane of twilled quartz cloth was disposed around each anode so as to be wrapped around each anode at a distance of about 3 cm from the anode surface. This membrane served to prevent the composition of the electrolyte from being changed by the products produced by the anode reaction during electrolysis. The following electrolyte composition and temperature were obtained by sampling the electrolyte at the portion where the cathode electrode was inserted between 5 cm and 15 cm under the electrolyte surface.

1. Composition of Electrolyte (In molar ratio)

$BaCl_2$ 23.73, $MgCl_2$ 22.65, $CaCl_2$ 13.06 NaCl 41.00, KCl 20.53, $TiCl_2$ 27.38 $TiCl_3$ 3.88

Prior to electrodeposition, the temperature of the above fused electrolyte was elevated so as to melt all components, whereafter the fused electrolyte was cooled to the electrodeposition temperature, thereby crystallizing solid particles of $BaCl_2$, KCl, $MgCl_2$, NaCl, $TiCl_2$ to serve as dispersed solid particles during the electrodeposition. The solid particles were estimated to mostly have a size of on the order of the solid particles added exterior of the system in Examples 1 and 2.

2. Temperature of Electrolyte: 473° to 476° C

3. Electrodes:

Cathode . . . A stainless steel cylinder having diameter of 32 mm and length of 100 mm Anode . . . Two sheets of carbon plates each 20 cm × 20 cm 1.5 cm thick Distance between the Electrodes . . . 15 cm 4. Electrolytic Current:

DC current of a cathode current density of 33 A/dm$^2$ was intermittently supplied at a rate of on-time 0.006 seconds and off-time 0.004 seconds, this intermittent current periodically being changed to an intermittent current with an intermitting period of 2.4 seconds, on-time 2.1 seconds and off-time 0.3 seconds.

5. Agitation:

The cathode electrode was alternately rotated for 16 seconds at 2350 rpm and 8seconds at 300 rpm over the electrolysis time. It took about 2.5 to 3 seconds, respectively, from the change-over time to the time when the number of each rotation was stabilized at a constant speed.

6. Electrolysis Time: 2 hours

7. Results (Appearance of Electrodeposit):

Compact thick plate having a semi-glossy and flat surface made of very fine crystals.

REFERENCE EXAMPLE 3

1. Composition of Electrolyte:

An electrolyte composed of 59 parts of LiCl and 41 parts of KCl (in molar ratio) having added thereto a raw material for titanium electrodeposition according to the method of adding the titanium salt components as described in the earlier References Examples and Examples. When this electrolyte was lowered in temperature to 400° C and kept at that temperature without agitation, about 8 weight % of $TiCl_2$ and about 3 weight % of $TiCl_3$ were present near the cathode position about 3 cm under the surface of the electrolyte after the passage of about one day and night after the temperature had been lowered. In Reference Example 3, the supernatant solution from the maintenance in the quiescent state for one day and night was used as the electrolyte.

2. Temperature of Electrolyte: 400° C

3. Electrodes:

Cathode . . . Molybdenum plate with submerged portion of 27 mm in length; 13 mm in width and 0.2 mm in thickness.

Anode . . . Round carbon bar, submerged portion of 150 mm in length and 8 mm in diameter.

Distance between electrodes . . . about 30 mm

4. Electrolytic Current:

DC current of a cathode current density of 100 A/dm² supplied intermitting period of 0.15 sec. a current-on time of 0.04 sec and a current-off time of 0.11 sec.

5. Agitation:

The cathode electrode was vibrated with a vibration period of 400 cycles/min, amplitude 36 mm and vibration direction 45° to the cathode flat surface.

6. Electrolytic Time: 30 min.

7. Results (Appearance of Electrodeposit):

Sooty, black fine powder stuck onto a silver-gray very thin foil.

EXAMPLE 6

Electrodeposition using an electrolyte in which the amount of the titanium salt component added to the electrolyte of Reference 3 was increased and crystallization and dispersion thereof were observed at the electrolysis temperature.

1. Composition of Electrolyte:

The electrolyte of Reference 3 had further added thereto metallic titanium and $TiCl_3$ according to the previously described method of adding the titanium salt component, and the temperature of this electrolyte was increased to a temperature sufficient to melt all components of the fused electrolyte. Thereafter, the temperature was lowered to 400° C to obtain an electrolyte (containing crystallized solid particles having a size estimated to be on the order of the solid particles added exterior of the system in Examples 1 and 2), comprising 19.2 weight % of $TiCl_2$ and 7.0 weight % of $TiCl_3$ near the cathode position about 3 cm under the electrolyte surface. This electrolyte was used in this example and the same vibration of the cathode electrode as in Reference Example 3 was carried out.

2. Temperature of Electrolyte, (3) Electrodes, (4) Electrolytic Current and (5) Agitation were all the same as those of Reference 3.

6. Electrolytic Time: 3 hours.

7. Results (Appearance of Electrodeposit):

Thick plate having a glossy, smooth surface with its peripheral portion being raised into a round dike-like ridge.

EXAMPLE 7

An alloy deposition is illustrated in this Example.

1. Composition of Electrolyte (in molar ration):

$BaCl_2$ 26.48, $MgCl_2$ 26.00, $CaCl_2$ 13.77, NaCl 41.00, KCl 17.63, $TiCl_2$ 26.04, $TiCl_3$ 2.10, $MnCl_2$ 0.87,

The fused electrolyte was first raised to a temperature sufficient to melt all components, whereafter the fused electrolyte was cooled to the electrodeposition temperature, thereby crystallizing solid particles having a size estimated to be in the order of that in the earlier examples, whereafter electrodeposition was conducted.

2. Temperature of Electrolyte: 470° C

3. Electrodes:

Cathode . . . Molybdenum plate, submerged portion 25mm in length, 10mm in width and 0.3mm in thickness.

Anode . . . Carbon plate with submerged portion 50mm in length, 30mm in width and 5mm in thickness.

4. Electrolytic Current:

DC current of a cathode current density of 60 A/dm² was intermittently supplied at a rate of on-time 0.3 seconds and off-time 1.2 seconds, i.e., 1.5 seconds intermitting period.

5. Agitation:

The cathode electrode was vibrated with a vibration period 400 cycle/min.(0.15 seconds) and a 30mm amplitude. Vibration direction: 45° toward the cathode suface.

6. Electrolysis Time: 30 min.

7. Results (Appearance of Electrodeposit):

Compact plate having a flat surface consisting of fine crystals, its peripheral portion being raised into a round or dike-like perimeter. As a result of X-rays diffraction analysis the content of the electrodeposit was found to be 10.7 of manganese persent per 87.0 of titanium, weight ratio.

These values were constant regardless of the position of the flat surface, except for the peripheral portion of the electrodeposit.

Further, it was also note that according to X-ray microanalysis the crystal construction was of the body-centered cubic structure type.

Accordingly, from the composition and the crystal construction, a Ti-Mn $\beta$-type alloy was obtained.

As will be appreciated by one skilled in the art, in the embodiments of the present invention where an in situ crystallization of solid particles is effected, it is not absolutely necessary that the fused-salt electrolyte be completely melted at the elevated temperature prior to crystallization, i.e., if some minor amount of the fused-salt electrolyte is not melted this does not excessively harm the electrodeposition process and, in some instances, to achieve lower production times certain small amounts of the components of the fused-salt electrolyte would not be melted at the elevated temperature. Nonetheless, the general rule will be that the melting of the components should be as substantially completely performed as is possible as this makes it much easier to obtain reproducible process runs. As a practical matter, complete melting is easily achieved even on an industrial scale.

The above examples are described with respect to the electrodeposition of titanium. However, the electrodeposition process of this invention can be also be applied to zirconium, aluminum, tantalum, niobium, uranium, manganese and other metals or alloys.

Further, with the electrodeposition process of this invention, if a metal, such as titanium, having very strong reactivity with negative elements is to be electrodeposited and a negative element such as oxygen, nitrogen, boron or the like is contained in the electrodeposited material as an alloying element, the above objects are attainable by using an electrolyte which has added thereto particles of a compound which has such a negative element(s) and which provides the electrodeposited metal with the element(s) and/or an electrolyte capable of having the required amount of the compound(s) fused therein.

While the invention has been described in detail and with reference to specific embodiments thereof, it will be apparent to one skilled in the art that various changes and modifications can be made therein departing from the spirit and scope thereof.

What is claimed is:

1. In the process of electrodepositing a metal or alloy on a cathode immersed in an agitated fused-salt electrolyte comprised of halide salts including salts of said metal or of the constituent metals of said alloy, and in which the electrodeposition is effected at a predetermined temperature of said electrolyte; the improvement comprising the steps, in advance of said electrodeposition, of providing at least one of said halide salts in said electrolyte in an amount substantially in excess of the solubility level thereof at said predetermined electrodeposition temperature, heating the fused-salt electrolyte to a temperature substantially above said electrodeposition temperature so as to melt the electrolyte including substantially all of each of said halide salts provided in said excess amount, and then cooling the thus melted fused-salt electrolyte to said electrodeposition temperature so as to crystallize a portion of each of said halide salts provided in said excess amount and form solid particles thereof which, when agitated near the surface of the cathode in the course of said electrodeposition thereon, cause the electrodeposited metal or alloy to be flat and homogeneous.

2. The process of claim 1; wherein said metal or alloy is titanium or a titanium alloy.

3. The process of claim 2; wherein said fused-salt electrolyte comprises a plurality of chloride salts, at least one of which is a chloride salt of the metal or alloy to be electrodeposited.

4. The process of claim 3; wherein said fused-salt electrolyte comprises $TiCl_2$ and $TiCl_3$.

5. The process of claim 4; wherein said electrodeposition is conducted at a temperature of from about 400° to about 550° C.

6. The process of claim 5; wherein said solid particles have a size of from about 1 $\mu$ to about 1 mm.

7. In the process of electrodepositing titanium on a cathode immersed in an agitated fused-salt electrolyte comprising at least the chloride salts $BaCl_2$, KCl, $MgCl_2$, NaCl, $CaCl_2$, $TiCl_2$ and $TiCl_3$, and in which the electrodeposition is effected at a predetermined temperature of said electrolyte in the range between approximately 400° and 550° C; the improvement comprising the steps, in advance of said electrodeposition, of providing at least one of said chloride salts in said electrolyte in an amount substantially in excess of the solubility level thereof at said predetermined electrodeposition temperature, heating the fused-salt electrolyte to a temperature substantially above said electrodeposition temperature so as to melt the electrolyte including substantially all of each of said chloride salts provided in said excess amount, and then cooling the thus melted fused-salt electrolyte to said electrodeposition temperature so as to crystallize a portion of each of said chloride salts provided in said excess amount and from solid particles thereof which are dispersed in the agitated electrolyte near the surface of the cathode for causing the electrodeposited titanium to be flat and homogeneous.

8. The process of claim 7; wherein said $BaCl_2$ is provided in the fused-salt electrolyte in said amount in excess of the solubility thereof at said electrodeposition temperature.

9. The process of claim 7; wherein the $TiCl_2$ is provided in the fused-salt electrolyte in said amount in excess of the solubility thereof at said electrodeposition temperature.

10. The process of claim 9; wherein said $BaCl_2$, KCl, $MgCl_2$ and NaCl are also provided in the fused-salt electrolyte in the amounts in excess of the respective solubilities thereof at said electrodeposition temperature.

* * * * *